United States Patent [19]

Zimmer

[11] 4,051,776

[45] Oct. 4, 1977

[54] DOWNSTREAM WEB TENSIONING FOR ROTARY SCREEN PRINTER

[76] Inventor: Johannes Zimmer, Ebentaler Strasse 133, A-9020 Klagenfurt, Austria

[21] Appl. No.: 682,174

[22] Filed: Apr. 30, 1976

Related U.S. Application Data

[63] Continuation of Ser. No. 450,854, March 13, 1974, abandoned.

[51] Int. Cl.[2] ..... B41F 15/24

[52] U.S. Cl. ..... 101/118; 101/115; 101/181; 242/75.5

[58] Field of Search ..... 101/DIG. 21, 115, 116, 101/118, 126, 181, 228; 242/75.3, 75.5, 75.51; 118/33

[56] References Cited

U.S. PATENT DOCUMENTS

| | | | |
|---|---|---|---|
| 3,024,155 | 3/1962 | Huber | 101/228 X |
| 3,102,472 | 9/1963 | Kieckhefer, Jr. | 101/228 |
| 3,548,747 | 12/1970 | D'Amato | 101/228 X |
| 3,650,490 | 3/1972 | Saunders | 242/75.3 |

FOREIGN PATENT DOCUMENTS

| | | | |
|---|---|---|---|
| 2,155,938 | 5/1972 | Germany | 101/118 |
| 1,285,553 | 8/1972 | United Kingdom | 101/126 X |

*Primary Examiner*—J. Reed Fisher
*Assistant Examiner*—R. E. Suter
*Attorney, Agent, or Firm*—Wenderoth, Lind & Ponack

[57] ABSTRACT

A web printing apparatus includes a positively driven printing base, a drive for driving a web to be printed over the printing base, and rollers positioned to contact and print a first portion of the web opposite the printing base. The drive moves the web at a higher speed than the base. The rollers press down on the web with sufficient force to create a friction connection between the web and the base, thus retarding and reducing the speed of the first portion of the web and tensioning a second portion of the web downstream of the rollers. The tension thus created in the second portion of the web is used to reduce the speed thereof.

5 Claims, 2 Drawing Figures

DOWNSTREAM WEB TENSIONING FOR ROTARY SCREEN PRINTER

This is a continuation of application Ser. No. 450,854, filed Mar. 13, 1974, now abandoned.

BACKGROUND OF THE INVENTION

The invention relates to an apparatus for printing a flexible web, in particular a paper web, comprising a positively driven printing base, printing cylinders capable of pressing against a web moving between the printing cylinders and the printing base, and a drive for removing the printed web.

In devices for multicolor printing of webs it is of greatest importance during the printing operation to avoid any relative displacement between the web and the printing base which runs synchronously with the printing rollers. Otherwise, the separately applied inks would be shifted in relation to one another. In textile printing, the achievement of full synchronization of web and printing is provided in that the web is glued to the printing base during the printing operation. In the case of paper, however, the same procedure would lead to the destruction of the material. Accordingly, during the printing and winding up of paper web material, attempts have been made to exclude as mush as possible the appearance of forces acting in the direction of a displacement of the web in relation to the printing base. In devices of the type that are not based on the principle of magnetic pressure application, this has been achieved by leading the web around a presser device having the printing rollers distributed over its circular periphery. The friction between the web and the presser, which is caused by the tension of the web, prevents an excessively easy slipping of the web. Yet, the drive of the web and the drive of the presser must be synchronized very carefully, since the friction forces obtainable through the tension of the web are small, and the printing rollers acting with a low pressure on the web do not substantially contribute to a real friction connection between the web and the presser.

In another device of the type described, a rotating blanket in the manner of a conveyor belt is associated with a plurality of printing cylinders. The blanket runs in a plane (i.e. has a flat run) between the printing cylinders that ordinarily consist of screen printing stencils having magnetic rollers arranged in the interior thereof. Tension produced in the web running over the flat area of the blanket would not at all lead to the appearance of friction forces between the blanket and the web in this case. On the basis of the consideration that variations in the tension of the web would thus necessarily have to lead to displacement between the web and the blanket, until the present time there has been placed great importance on avoiding any tension in the web in the area of the blanket. Consequently, the unreeling or supply spool of the web has been provided with a drive, i.e. the web was pushed to a certain extent into the printer. Behind or downstream of the printing rollers, the web was allowed initially to sag untensioned, in which connection the degree of sagging was employed for controlling a drive for the winding-up spool. Owing to the difficulties in synchronizing the three drives that are provided in such devices, it is not possible to eliminate the danger of accumulation of substantially untensioned web, so that the theoretically obtainable printing speed of the printing system cannot be maintained over relatively long periods of time.

SUMMARY OF THE INVENTION

The present invention avoids the above-mentioned disadvantages by providing that the printing cylinders exert a pressure downwardly sufficient for producing a friction connection between the printing base and the web. This friction connection induces or insures synchronization between the printing-base-contacting portion of the web and the positively driven printing base, even when in the case of absence of cylinder pressure, the speed of the web would be greater than the speed of the printing base. The speed of removal of the web is made equal to the speed of the web portion carried along by the printing base by known types of control devices which react to the tension of the web portion situated subsequently to or downstream of the printing cylinders.

The cylinders which can be used for the application of pressure and which effect the synchronization of the speeds of the web and the printing base may differ with regard to function and type of application of pressure. Cyinders that are provided merely for the purpose of the invention may be employed, or, e.g. use may be made of rollers for laminating or impregnating the web. Now, it has unexpectedly been found that the cylinders employed for printing the web may be used for achieving the above synchronization. Even the extremely thin-walled cylinders required for a screen printing operation can produce the required pressure, insofar as they are used in the known manner for the magnetic application of pressure.

Accordingly, the preferred embodiment of the present invention employs magnetically tightened or pressing printing cylinders for the first time, not only for the application of ink, but simultaneously also for producing a friction connection between the web and the positively and separately driven printing base of such a strength that the web may be subjected to tensions in the order of magnitude of 50 kp per *m* width. While until the present time attempts were made, in advance to printing, to set the drive of the web at a speed to avoid as much as possible the appearance of differences of velocity between the printing base and the web, in accordance with the present invention the speed of the web is necessarily made equal to that of the printing base, and the change in tension thus produced in the printed portion of the web is employed for controlling the drive of the web. The speed of the drive of the web is thus selected to be higher than the speed of the positively driven printing base, so that the pressure of the printing cylinders produces an increase in the tension of the web, which tension is employed for reducing the winding-up velocity of the web, e.g., by means of a known slip clutch or known regulation devices.

In contrast to the known devices described above, the device of the invention produces in particular the advantage that the web can be removed continuously from the spool by the printing device proper, without the necessity of equipping the spool with a special drive. In the most simple case, the web can now be pulled under tension generally from spool to spool, which allows a higher working or printing speed than was previously possible.

BRIEF DESCRIPTION OF THE DRAWINGS

The invention will be explained in more detail in the following text with reference to the accompanying drawings wherein.

DETAILED DESCRIPTION OF THE INVENTION

Figure 1:
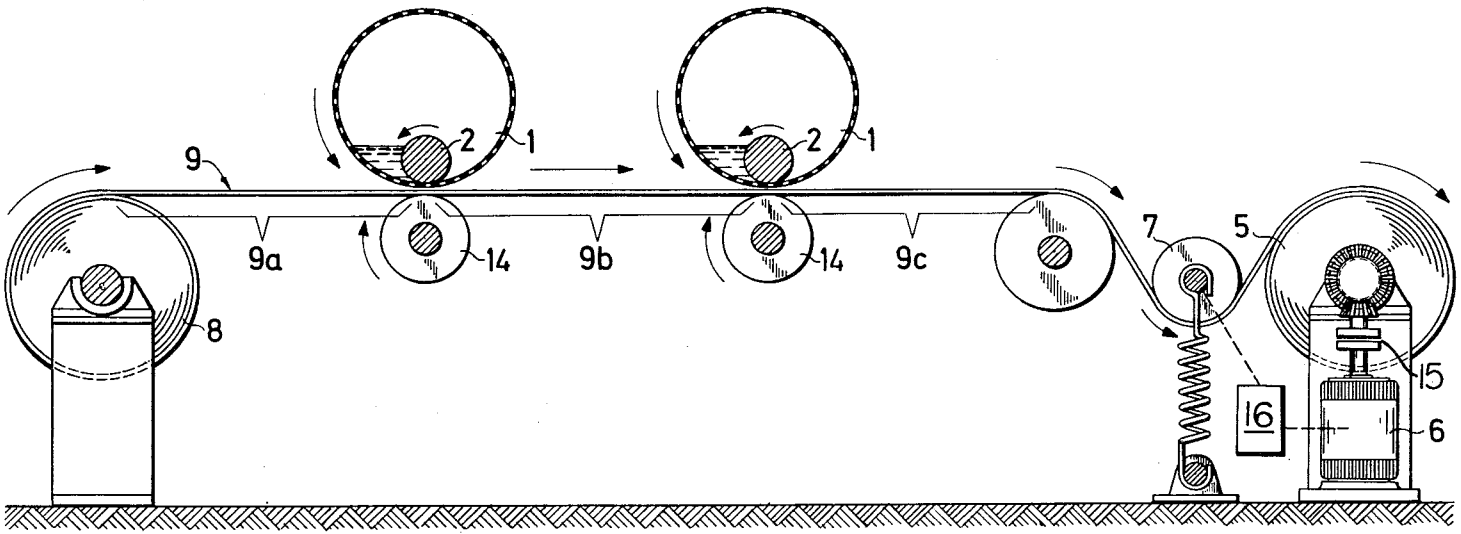
FIG. 1 is a schematic side view of a first embodiment of the present invention.

The web printing device illustrated schematically in FIG. 1 includes a plurality of printing cylinders 1, two cylinders being illustrated. In the case of a screen printing procedure, the cylinders are specifically perforated cylindrical stencils. On activation of known type magnetic rollers 14 that form the printing base beneath each cylinder, the printing cylinders 1 are pressed toward magnetic rollers 14 by the force of attraction thereto of known magnetizable doctor rolls or squeegees 2 arranged in the interior of the cylinders. Rollers 14 are positively driven in a known manner, such as for example a drive motor. Otherwise, and in contrast with the schematic representation of the drawings, the cylinders rest under their own weight on magnetic rollers 14 or a web 9 of material to be printed. Cylinders 1 may be synchronously driven in a known manner, or if printing cylinders 1 are not equipped with a drive, they are advantageously combined or coupled to one another, in order to avoid any difference in their velocities of rotation.

In the embodiment illustrated in FIG. 1, web 9 is wound by means of a drive 6 onto a spool 5 and at the same time unwound from a supply spool 8. In the area of printing cylinders 1, the web runs completely even or plane, so that the tension of the web alone is not sufficient to produce a frictional connection between the printing bases (i.e. rollers 14) and web 9.

Frictional connection between web 9 and the printing bases is established when the magnetic rollers 14 of the ink application device are positively and independently rotated and are activated, i.e. when printing cylinders 1 are pressed against the upper surface of web 9 due to magnetic attraction of rolls 2 toward rollers 14. If the original speed of web 9, established by drive 6, is higher than the speed of movement of positively driven magnetic rollers 14, the speed of movement of a web section 9*c* thus tends to be retarded to the speed of a web section 9*b* held by magnetic rollers 14. Preferably, without cylinder pressure the web speed is approximately 1% higher than the speed of positively driven rollers 14.

Such retardation is possible even when the velocity of drive 6 of spool 5 continues to remain higher than that of magnetic rollers 14, by providing a known type of slip clutch 15 (shown schematically in FIG. 1) between drive 6 and web 9. Also, the retardation of web section 9*c* may be used to reduce the speed of drive 6. For instance, a compensating roller 7 may be provided to act on web 9 and to tension a spring when the tension of web 9 is increased. The movement of roller 9 or the spring may be used by known control or regulating systems (such as 16 shown schematically in FIG. 1) to control the speed of drive 6.

An advantageous feature of the invention consists in the arrangement of a drive 6, in cooperation with magnetic rollers 14 and printing cylinders 1, for moving an unprinted web section 9*a*, a web section 9*b* situated between magnetic rollers 14, and printed web section 9*c*, since the smallest possible difficulties in web synchronization result in this manner.

On the other hand, it is not necessary to wind up web 9 by means of drive 6. This drive could also act on a traction station traversed by the web in order to be subsequently further treated, possibly in an untensioned state.

Figure 2:
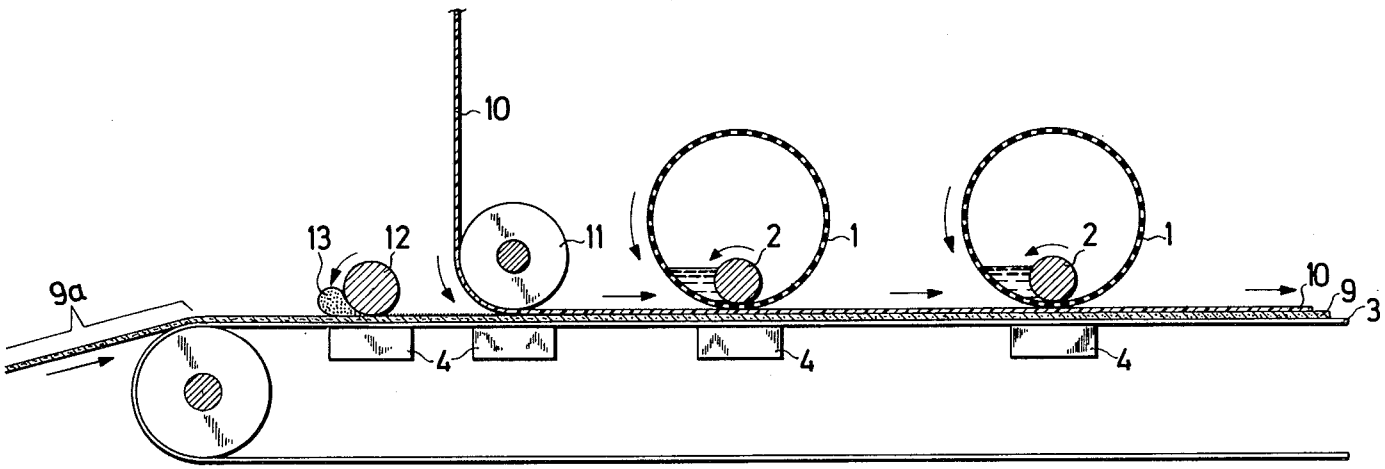
FIG. 2 is a schematic side view of a second embodiment of the present invention.

The embodiment of FIG. 2 differs from that of FIG. 1 in that the web to be printed in this case is produced through the lamination of a layer 9 with a cover layer 10 the web resting on moving blanket 3 that is positively driven and that forms the printing base along with supports 4. Since an application roller 12 for the application of glue 13 used for bonding the layers 9 and 10, as well as a lamination roller 11, cooperate with the blanket 3 in the same manner as printing rollers 1, they are likewise employed for web retardation and synchronization in accordance with the invention.

While the speed of printing has been limited in known systems due to deficient synchronization of the web, the very high printing speed obtainable in accordance with the present invention may lead to problems due to the fact that the applied ink does not dry sufficiently between separate printing cylinders 1. Accordingly, the arrangement of an intermediate drier, such as a hot air blower or an infrared radiation device, between printing cylinders 1 is frequently of advantage.

It will be apparent that various modifications may be made to the specific structural embodiments discussed above without departing from the scope of the invention.

What is claimed is:

1. In an apparatus for printing a flexible web of material, particularly a web of paper material, such apparatus being of the type including positively driven magnetic rollers; first drive means for positively driving said magnetic rollers at a first speed; second driving means for driving a web of material from a supply over said magnetic rollers; and hollow perforated cylindrical printing stencils, one each positioned to contact and print a first portion of said web opposite a respective of said magnetic rollers; the improvement wherein said web is maintained substantially planar or flat in the area of contact with said cylindrical stencils;

said second driving means is positioned downstream of said cylindrical stencils and comprises means tending to drive said web in the same direction as said driven magnetic rollers, but at a second speed higher than said first speed;

pressure means, including doctor rolls of magnetically attractable material, one each positioned within a respective one of said cylindrical stencils, for causing said cylindrical stencils to contact said first portion of said web with sufficient pressure to produce a friction connection and engagement between said web and said positively driven magnetic rollers, and for thereby reducing the speed of movement of said first portion of said web in the area of contact with said cylindrical stencils to said first speed of said magnetic rollers, thus tending to create a speed differential between said first portion of said web and a second portion of said web which is downstream of said cylindrical stencils and which is driven by said second driving means, whereby said second portion of said web downstream of said cylindrical stencils is tensioned;

said first driving means for driving said magnetic rollers being independent of said friction connection and engagement between said web and said magnetic rollers; and means responsive to the tension thus created in said second portion of said web to reduce the speed of said second portion of said web.

2. The improvement claimed in claim 1, wherein said second driving means comprises means tending to drive said web at said second speed approximately 1% higher than said first speed of said positively driven magnetic rollers.

3. The improvement claimed in claim 1, wherein said reducing means comprises slip clutch means, connected between said second portion of said web and said second driving means, for allowing said second driving means to operate at said higher second speed while retarding the speed of said second portion of said web.

4. The improvement claimed in claim 1, wherein said reducing means comprises a compensating roller in contact with and responsive to movement of said second portion of said web due to change in tension thereof; and regulator means connected to said second driving means and responsive to movement of said compensating roller for retarding the driving speed of said second driving means, and thereby retarding the speed of said second portion of said web.

5. The improvement claimed in claim 1, further comprising a wind-up spool means driven by said second driving means for winding up said web.

* * * * *